US007199364B2

(12) United States Patent
Thakur

(10) Patent No.: US 7,199,364 B2
(45) Date of Patent: Apr. 3, 2007

(54) ELECTROSPRAY ION SOURCE APPARATUS

(75) Inventor: Rohan A. Thakur, Los Altos, CA (US)

(73) Assignee: Thermo Finnigan LLC, San Jose, CA (US)

( * ) Notice: Subject to any disclaimer, the term of this patent is extended or adjusted under 35 U.S.C. 154(b) by 49 days.

(21) Appl. No.: 11/128,653

(22) Filed: May 13, 2005

(65) Prior Publication Data

US 2005/0258358 A1 Nov. 24, 2005

Related U.S. Application Data

(60) Provisional application No. 60/573,225, filed on May 21, 2004.

(51) Int. Cl.
*H01J 49/44* (2006.01)

(52) U.S. Cl. ..... 250/288

(58) Field of Classification Search ..... 250/288
See application file for complete search history.

(56) References Cited

U.S. PATENT DOCUMENTS

| | | | | |
|---|---|---|---|---|
| 3,616,596 | A | 11/1971 | Campargue | |
| 4,209,696 | A | 6/1980 | Fite | |
| 4,298,795 | A | 11/1981 | Takeuchi et al. | |
| 4,298,798 | A | 11/1981 | Huffman | |
| 4,531,056 | A | 7/1985 | Labowsky et al. | |
| 4,861,988 | A | 8/1989 | Henion et al. | |
| 4,935,624 | A | 6/1990 | Henion et al. | |
| 4,963,736 | A | 10/1990 | Douglas et al. | |
| 5,122,670 | A | 6/1992 | Mylchreest et al. | |
| 5,157,260 | A | 10/1992 | Mylchreest et al. | |
| 5,170,053 | A | 12/1992 | Hail et al. | |
| 5,171,990 | A | 12/1992 | Mylchreest et al. | |
| 5,345,079 | A | 9/1994 | French et al. | |
| 5,349,186 | A * | 9/1994 | Ikonomou et al. | 250/288 |
| 5,412,208 | A | 5/1995 | Covey et al. | |
| RE35,413 | E | 12/1996 | Mylchreest et al. | |
| 5,750,988 | A | 5/1998 | Apffel et al. | |
| 6,147,347 | A | 11/2000 | Hirabayashi et al. | |

(Continued)

FOREIGN PATENT DOCUMENTS

WO WO 2004/026448 4/2004

OTHER PUBLICATIONS

Balogh, Michael P., "Source Design and the Utility of Multimode Ionization," www.chromatographyonline.com, LGCG North America, vol. 21 ( No. 10), p. 984-991, (Oct. 2003).

*Primary Examiner*—David Vanore
(74) *Attorney, Agent, or Firm*—Charles B. Katz; David E. Allred

(57) ABSTRACT

An electrospray interface for forming ions from a liquid sample in a mass analyzing system includes a capillary tube having a free end for introducing a spray of droplets into an ionization chamber, a first gas passageway positioned near the capillary tube for directing a first gas stream into the ionization chamber, and a second gas passageway positioned more remotely from the capillary tube for directing a second, low-velocity gas stream into the ionization chamber. The second gas stream is heated to increase the droplet desolvation rate. A heated sampling capillary having an end extending into the ionization chamber guides the analyte ions toward a mass analyzer and evaporates the solvent from any incompletely desolvated droplets entering the sampling capillary.

23 Claims, 4 Drawing Sheets

U.S. PATENT DOCUMENTS 6,511,850 B1 1/2003 Vigh et al.
6,593,568 B1 7/2003 Whitehouse et al.
6,642,515 B1 11/2003 Yamaguchi
6,646,256 B2 11/2003 Gourley et al.
6,646,257 B1 * 11/2003 Fischer et al. ..... 250/288
6,653,626 B2 11/2003 Fischer et al.
6,667,474 B1 12/2003 Abramson et al.
6,703,611 B2 3/2004 Glish et al.
6,759,650 B2 7/2004 Covey et al.
2002/0185595 A1 12/2002 Smith et al.
2003/0168591 A1 9/2003 Smith et al.
2004/0046118 A1 3/2004 Apffel, Jr. et al.
2004/0046126 A1 3/2004 Fisher et al.

* cited by examiner

ELECTROSPRAY ION SOURCE APPARATUS

CROSS-REFERENCE TO RELATED APPLICATIONS

This application claims the benefit of Provisional Application No. 60/573,225 filed May 21, 2004, which is incorporated by reference herein.

BACKGROUND OF THE INVENTION

1. Field of the Invention

The invention relates generally to ion sources for mass analyzer systems, and more particularly to an electrospray interface.

2. Description of the Prior Art

In its basic form, the electrospray process consists of flowing a solution of the analyte through a capillary tube which is maintained at a high electrical potential with respect to a nearby surface. The solution emerges from a free end of the capillary tube and is dispersed into a fine mist of electrically charged droplets by the potential gradient at the tip of the capillary tube. The size of the droplets formed is determined by a combination of factors including, but not limited to, the solution flow rate, the applied potential and the properties of the solvent. Nebulization may be assisted by directing a co-axial high-velocity gas stream proximate to the free end of the capillary.

Within the ionization chamber, the droplets reduce in size by evaporation of the solvent. Droplet size reduction may also be effected by a microexplosion mechanism caused by the development of high charge density at or near the droplet surface. Eventually, complete evaporation of the solvent is accomplished as the larger droplets become smaller droplets, and the analyte enters the gas phase as an ion.

Under the appropriate conditions, the electrospray resembles a symmetrical cone consisting of a very fine mist (or fog) of droplets (circa 1 μm in diameter.) Excellent sensitivity and ion current stability can be obtained if the fine mist is consistently produced. Unfortunately, the quality of the electrospray is highly dependent on the bulk properties of the analyte solution (e.g., surface tension and conductivity). A poor quality electrospray may contain larger droplets (greater than 10 μm diameter) or a non-dispersed droplet stream. Partially desolvated droplets can pass into a vacuum system, causing sudden increases in pressure and instabilities in the ion current from a mass spectrometer, and reducing sensitivity.

The prior art includes a number of attempts to provide an improved electrospray ion source apparatus that avoids the aforementioned problem associated with incomplete desolvation. Examples of various prior art approaches to addressing the incomplete desolvation problem are disclosed in U.S. Pat. No. 4,935,624 to Henion et al., U.S. Pat. No. 5,157,260 to Mylchreest et al., and U.S. Pat. No. 5,349,186 to Ikonomou et al. However, the prior approaches have been only partially successful at solving the desolvation problem, and some of the approaches are not favored because they create a different set of operational problems.

SUMMARY

According to one embodiment of the invention, an ion source apparatus is provided having a capillary tube to which a voltage is applied, first and second gas passageways, and a sampling capillary for directing analyte ions toward a mass analyzer. A liquid sample containing an analyte travels through the capillary tube and is introduced into an ionization chamber as a spray of electrically charged droplets. The first gas passageway, having an end region positioned proximate to the free end of the capillary tube, directs a first gas stream into the ionization chamber which focuses the droplet spray cone or assists in droplet nebulization. The second gas passageway, located more remotely from the capillary tube free end, directs a second stream of heated gas into the ionization chamber at low velocity. The second gas stream is co-directional to, and preferably has a major axis parallel to, the major axis of the droplet spray cone and first gas stream. The heated second gas stream promotes the production of analyte ions by increasing the droplet desolvation rate. An annular heater arranged about the capillary tube may be employed to heat the second gas stream.

The ion source apparatus is also preferably provided with a controllably heated sampling capillary, through which the ions travel toward a mass analyzer. Heating the capillary ensures that the solvent is completely evaporated from any partially desolvated droplets entering the sampling capillary, thereby improving the ion signal and avoiding operational problems arising from the passage of incompletely desolvated droplets into the low-pressure regions of the mass analyzer system.

DETAILED DESCRIPTION OF PREFERRED EMBODIMENTS

Figure 1:
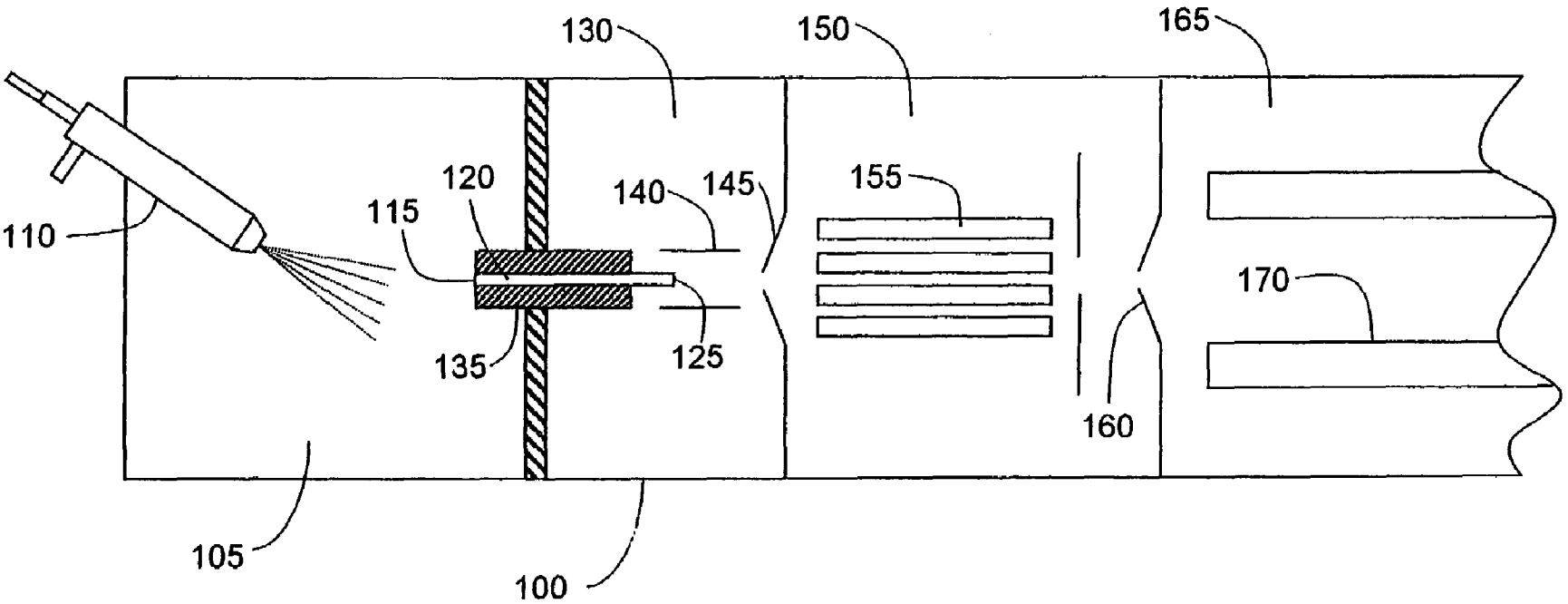
FIG. 1 is a symbolic depiction of an exemplary mass analyzer system utilizing an ion source apparatus implemented in accordance with an embodiment of the invention.

Unless otherwise defined, all technical and scientific terms used herein have the meaning commonly understood by one of ordinary skill in the art to which this invention belongs. All publications, patent applications, patents, and other references mentioned herein are incorporated by reference in their entirety. In case of conflict, the present specification, including definitions, will control. The disclosed materials, methods, and examples are illustrative only and not intended to be limiting. Skilled artisans will appreciate that methods and materials similar or equivalent to those described herein can be used to practice the invention.

Exemplary embodiments of the invention will now be described and explained in more detail with reference to the embodiments illustrated in the drawings. The features that can be derived from the description and the drawings may be used in other embodiments of the invention either individually or in any desired combination.

FIG. 1 is a symbolic depiction of an exemplary mass analyzer system 100 utilizing the ion source apparatus implemented in accordance with an embodiment of the invention. Mass analyzer system 100 includes an ionization chamber 105 into which a liquid sample is introduced as a spray of electrically charged droplets using an ion probe assembly 110. The liquid sample consists of at least one analyte substance dissolved in at least one solvent, and may take the form of the eluent from a liquid chromatograph (LC) column. As will be discussed in further detail hereinbelow, ion probe assembly 110 may be advantageously provided with two gas passageways through which first and second gas streams, which respectively assist in the spray formation and droplet desolvation processes, are directed into ionization chamber 105.

A portion of the ions formed by desolvation of the droplets and ionization of the analyte within ionization chamber 105 flow under the influence of an electric field into a first end 115 of sampling capillary 120. Sampling capillary 120 communicates via a second end 125 thereof with a second chamber 130, which is maintained at a lower pressure relative to ionization chamber 105. The resultant pressure gradient causes ions entering sampling capillary first end 115 to traverse sampling capillary 120 and emerge into second chamber 130 via second end 125. According to the arrangement depicted by FIG. 1, the central longitudinal axis of sampling capillary 140 is angularly offset from the central longitudinal axis of ion probe assembly 110 (and of the droplet spray cone); however, the depicted arrangement is presented only by way of a non-limiting example, and mass analyzing systems employing an aligned or orthogonal ion probe/sampling capillary geometry are considered to be within the scope of the present invention.

In accordance with the preferred embodiment, sampling capillary 120 is controllably heated to ensure complete evaporation of any remaining solvent associated with partially desolvated droplets entering the sampling capillary first end 115. Completion of the desolvation process within sampling capillary 120 improves the ion signal produced by mass analyzer and avoids operational problems arising from the passage of partially desolvated droplets into the low-pressure regions of mass analyzer system 100. Heating of sampling capillary 120 may be achieved by use of an annular resistance heater, disposed within a capillary support block 135. An illustrative example of a heated sample capillary assembly employing an annular resistance heater is presented in U.S. Pat. No. 6,667,474 to Abramson et al., which is incorporated by reference. The temperature of sampling capillary 120 is adjusted by appropriately varying the current supplied to the heater. In some implementations of the invention, the circuit supplying current to the heater may use a feedback loop so that sampling capillary 120 can be maintained at a target temperature. In typical operation, sampling capillary 120 is heated to a temperature in the range of 150°–400° C. Those skilled in the art will recognize that the optimal temperature of sampling capillary 120 will depend on various considerations, including the liquid sample flow rate, the temperature of ionization chamber 105, the droplet size distribution of the spray cone, and properties of the analyte solution.

Ions emerging from second end 125 of sampling capillary 120 are centrally focussed by tube lens 140 and subsequently pass via a skimmer 145 into a third chamber 150, which is maintained at a reduced pressure relative to second chamber 130. A multipole lens assembly 155 disposed within third chamber 150 directs the ions from the skimmer 160 into an analyzing chamber 165. A mass analyzer, such as a quadrupole mass analyzer 170, situated within analyzing chamber 165, filters the entering ions according to their mass-to-charge ratio, and an associated detector (not depicted) detects ions passing through mass analyzer 170 and produces an output representative of the incidence of ions having a specified mass-to-charge ratio.

It will be appreciated that although a quadrupole mass analyzer is depicted in FIG. 1 and described above, the ion source apparatus may be used in connection with any suitable type or combination of types of mass analyzers, including without limitation time-of-flight (TOF), Fourier transform (FTMS), ion trap, magnetic sector or hybrid mass analyzers. It should also be recognized that other ion sampling and ion guiding configurations may be substituted for the sampling capillary and ion transmission system described above without departing from the scope of the invention. For example, alternative configurations of the sampling capillary include, but are not limited to, sample apertures, orifices, non-conductive and semi-conductive capillaries.

Figure 2:
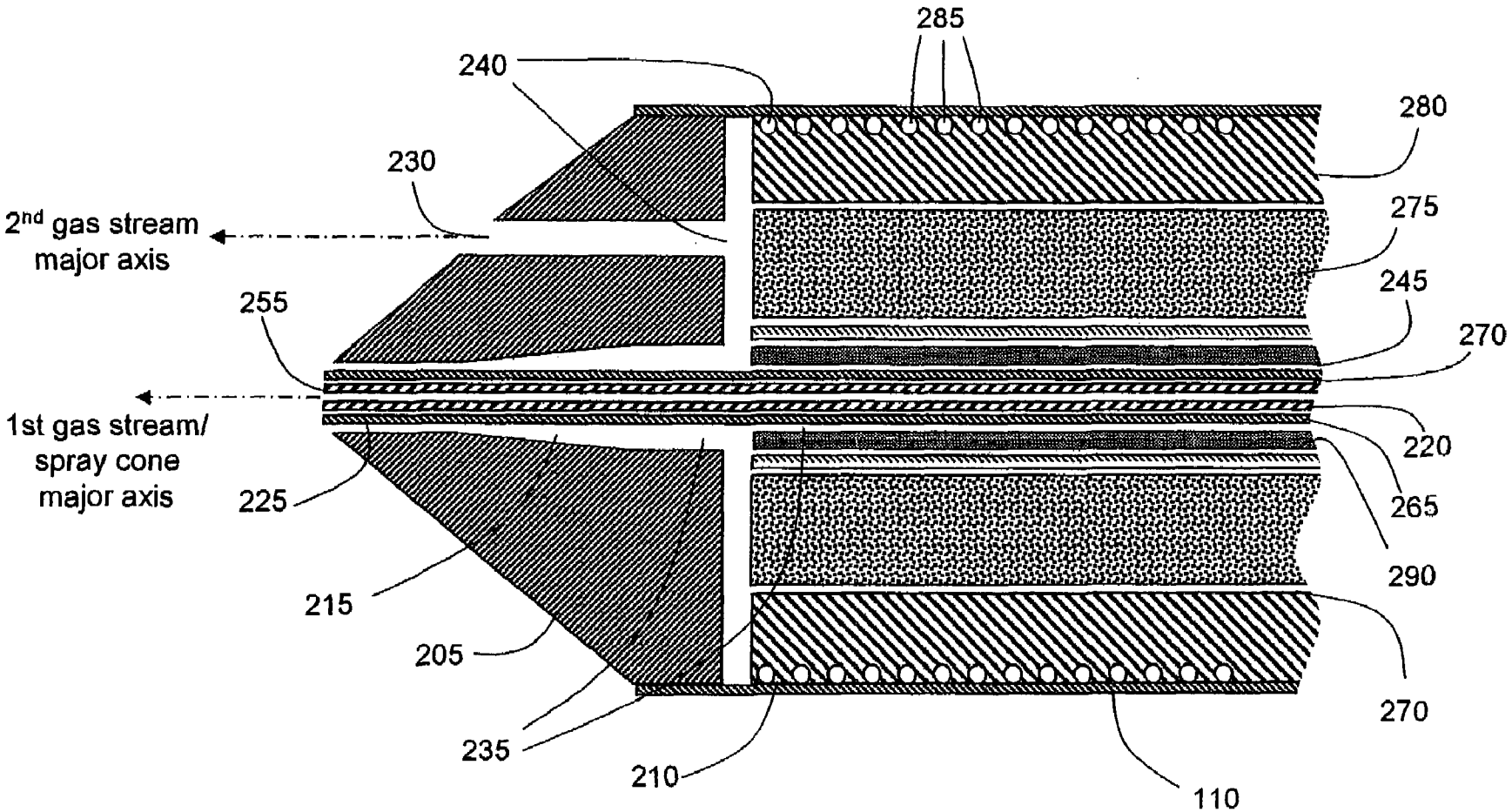
FIG. 2 is a fragmentary longitudinal cross-sectional view of an ion probe assembly.

Aspects of the invention may be more easily understood with reference to FIG. 2, which depicts a fragmentary longitudinal cross-sectional view of ion probe assembly 110. It is noted that FIG. 2 is intended only as a symbolic representation and does not accurately portray the relative or absolute dimensions of the ion probe assembly components. Ion probe assembly 110 may take the form of a two-part structure consisting of a nozzle 205 releasably engaged (by cooperating threads or other suitable measure) with a body 210. The two-part configuration enables the easy and rapid interchangeability of nozzles. Thus, the probe may be supplied with multiple nozzles, wherein each nozzle has a design optimized for a particular set of operating conditions and analyte types, allowing the operator to select and mount the appropriate nozzle for a particular experiment. Additionally, the two-part configuration facilitates cleaning and replacement of the nozzle structure. Nozzle 205 is provided with a central axial bore 215 through which a capillary tube 220 extends, and first and second gas passageway end regions 225 and 230. Capillary tube 220 extends rearwardly from nozzle 205 through a bore 245 defined in body 210 and terminates at its rearward end in an inlet port coupled to the liquid sample source, which may be the outlet of (for example) an LC column. First and second gas passageways 235 and 240 within body 210 communicate, respectively, first and second passageway end regions 225 and 230 in nozzle 205. Gas flows are separately supplied to first and second gas passageways 235 and 240 via inlet ports (not depicted) located on ion probe assembly externally to ionization chamber 105. A suitable configuration of sealing elements (not shown) may be disposed between nozzle 205 and body 210 to prevent leakage of the gas flows between passageways 225/235 and 230/240.

In a preferred embodiment, nozzle 205 is fabricated from a ceramic material such as silicon nitride or aluminium oxide, which serves to electrically isolate the high voltage (0 to±8 kV) applied to the electrospray capillary tube, which in this example is a 26 gauge stainless-steel tube encasing a fused silica capillary tube, through which liquid is delivered to the mass spectrometer, and the metal casing of the heat exchanger assembly (grounded, 0V or low voltage). Since the heated auxiliary gas exits through the ceramic nozzle, the material has to withstand high temperatures without breakdown or out-gas chemical entities that can contribute to chemical contamination. Furthermore, the nozzle is easily replaceable for easy maintenance, and experimentation with nozzles of different geometries.

Capillary tube 220 is preferably formed from a metal or other conductive material so that it can be maintained at a high positive or negative) voltage with respect to nearby surfaces within ionization chamber 105 and thereby cause the droplets emitted from free end 255 to be electrically charged. The voltage may be applied by a voltage source (not depicted) having a lead attached to capillary tube 220 or to a conductive surface in electrical communication therewith. The inner diameter of capillary tube 220 will typically be in the range of 50–500 μm, but may lie outside this range to accommodate liquid sample flow and other operational requirements. In the embodiment depicted in the figures, capillary tube 220 is surrounded by a sheath 265. The radially opposed surfaces of capillary tube 220 and sheath 265 define there between an annular region 270 through which a low-surface tension sheath liquid (such as methanol, acetonitrile, or 2-methoxyethanol) may be introduced. The sheath liquid mixes with the liquid sample in a mixing region located at the free end 255 of capillary tube 220, thereby reducing its surface tension and facilitating nebulization. This process is described in greater detail in U.S. Pat. No. 5,171,990 to Mylchreest et al., the disclosure of which is incorporated by reference. It should be recognized that the ion source apparatus and method of the instant invention may be practiced either with or without introduction of a sheath liquid.

Figure 3:
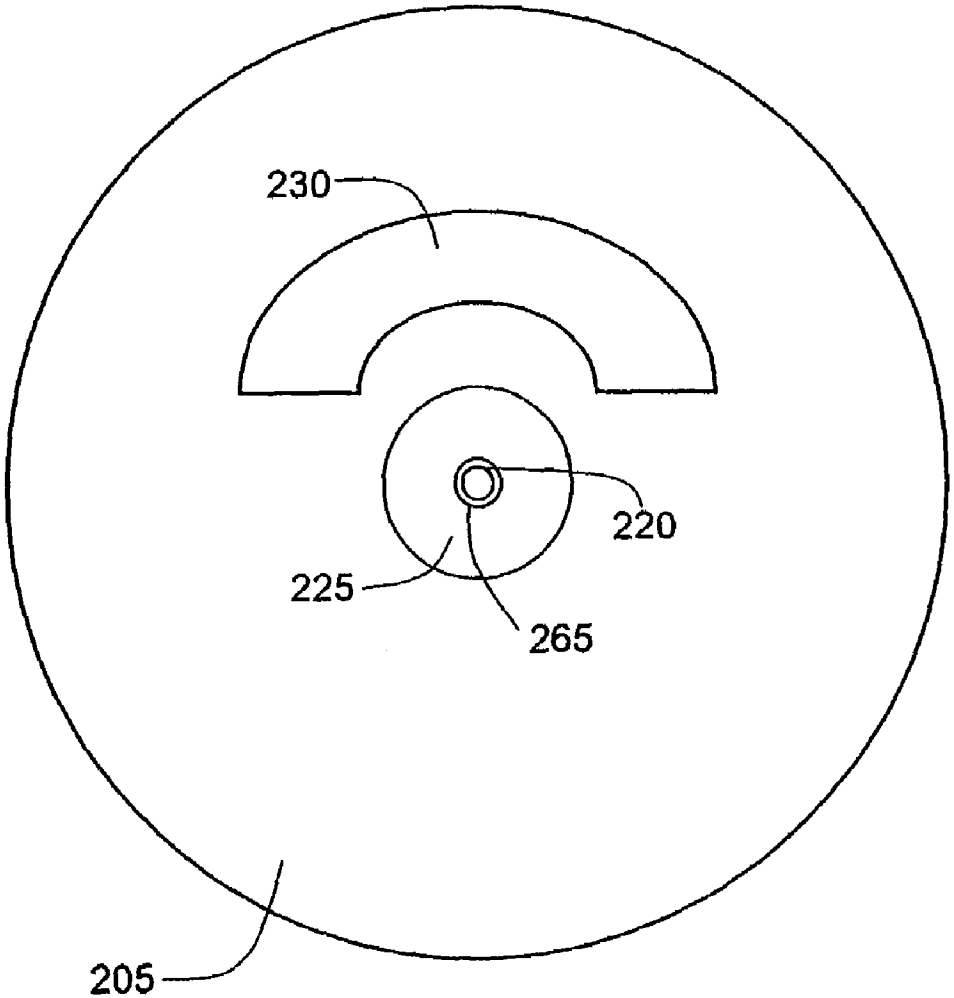
FIG. 3 is a front elevated plan view of the ion probe assembly nozzle.

Nozzle 205 is adapted with a first gas passageway end region 225 through which a first gas stream is directed into ionization chamber 105. Referring to FIG. 3, which shows a front view of nozzle 205, end region 225 will preferably have an annular cross section and be located outwardly adjacent to sheath tube 265. As used herein, the term "adjacent" means that the components referred to are located proximally to one another, rather than specifying immediate adjacence, i.e., two components may be considered to be adjacent one another even if other components are interposed therebetween. It should be further noted that although FIG. 2 depicts capillary tube 220 as being longitudinally coextensive with end region 225, capillary free end 255 alternatively may be longitudinally retracted or extended with respect to the outlet of end region 225. The first gas stream emerging from end region 225 will typically have a central longitudinal axis (also referred to herein as the major axis) that is substantially coincident with the central longitudinal axis of capillary tube 220 and that of the droplet spray cone emitted from free end 255.

In a preferred embodiment, the first gas stream has a velocity at the capillary tube free end 255 that is significantly below a characteristic nebulizing velocity. The characteristic nebulizing velocity is the velocity at which a gas stream exerts a strong shear force on the incipient droplets emerging from capillary tube 220 (or from sheath tube 265, if a sheath liquid is employed), thereby removing the droplets from free end 255 and altering the resultant droplet size distribution in the spray cone. A typical nebulizing velocity will fall in the range of 140–250 meters/second, although the velocity will vary according to the capillary tube free end dimensions and geometry as well as the properties of the liquid sample. A more detailed discussion of the nebulizing velocity is set forth in U.S. Pat. No. 5,349,186 to Ikonomou et al., the disclosure of which is incorporated by reference. The first gas stream will preferably have a velocity well below the foregoing range, for example on the order of 5 meters/second. At this velocity, the first gas stream influences the geometry of the spray cone (by obstructing the spreading of the spray cone as droplets leave capillary tube 220) and focuses the spray cone toward sampling capillary 120, but does not participate in the droplet formation process. In alternative embodiments, the first gas stream has a velocity at or above the characteristic nebulizing velocity. The first gas stream will typically consist of nitrogen gas supplied from a pressurized source, although other gases or combinations of gases having suitable properties may be substituted.

Nozzle 205 is additionally adapted with second gas passageway end region 230 through which a second gas stream is directed into ionization chamber 105. The second gas stream is heated to increase the rate at which solvent is evaporated from the liquid sample droplets. In a preferred configuration, the second gas stream is introduced into ionization chamber 105 at a very low velocity (typically around 0.1–2.5 meters/second). As depicted in the figures, second passageway end region 230 is located at a greater radial distance from capillary tube 220 relative to first passageway end region 225. In the preferred embodiment, the second gas stream has a longitudinal (major) that is substantially parallel to the major axis of the first gas stream and spray cone. Alternative embodiments may orient the major axis of the second gas stream transversely with respect to the major axis first gas stream or spray cone. However, in each embodiment, the second gas stream is co-directional to the first gas stream, i.e., the first and second gas stream flow in the same lateral direction (left-to-right in FIG. 1) toward sampling capillary 120. The co-directional flow arrangement of the first and second gas streams is in contradistinction to the counterflow or "sweep flow" arrangement (disclosed, for example, in U.S. Pat. No. 5,157,260 to Mylchreest et al.) wherein a drying gas flows through the ionization chamber in a direction opposite to the direction of droplet travel. The second gas stream will typically consist of nitrogen gas supplied from a pressurized source, although other gases or combinations of gases having suitable properties may be substituted.

Referring again to FIG. 3, the outlet of second passageway end region 230 may be arc-shaped or otherwise radially asymmetric with respect to capillary tube 220, i.e., it may be located in a preferred radial direction relative to the capillary tube. In alternative embodiments of the invention, end region 230 may have an annular cross-section positioned radially outwardly of first gas passageway end region 225. The outlet of the second passageway end region 230 maybe configured in several geometries, radially directed either symmetrically or asymmetrically and is not limited to the description in FIG. 3.

It should be further noted that although the preferred embodiment locates second gas passageway 240 within ion probe assembly 110, other embodiments of the invention may utilize a different arrangement wherein the second gas passageway is formed in a structure that is apart and separate from ion probe assembly 110. For example, the second gas stream may be introduced into ionization chamber 105 through a conduit that penetrates the ionization chamber wall. In these embodiments, the major axis of the second gas stream will still be co-directional and preferably parallel to the major axis of the first gas stream and droplet spray cone.

Ion probe assembly 110 is preferably provided with a heat exchanger assembly 270 for heating the second gas stream to the desired temperature. Under typical operating conditions, the temperature of the second gas stream is raised to between 75–150° C. Heat exchanger assembly 270 includes an annular resistance heater 275 located in interior of the ion probe assembly body 210. Annular resistance heater 275 has a cylindrical interior bore through which capillary tube 220 and first gas passageway 235 extend. The amount of heat produced by resistance heater 275 (and consequently the amount of heat transferred to the second gas stream temperature) is controlled by adjusting the voltage applied to the heater by a voltage source (not depicted) in electrical communication with the heater. An annular heat exchanger block 280, fabricated from a thermally conductive material is machined in a manner so as to facilitate the auxiliary gas stream to spiral as it is forced forward in an attempt to maximize contact with as much surface area as possible and arranged in thermal communication with heater 275. Heat generated by heater 275 is transferred (by radiative, convective and/or conductive modes) to heat exchanger block 280, which in turn heats the second gas stream Spiral pathway 285 provides sufficient contact area between heat exchanger block 280 and the gas flowing through second gas passageway 285 to heat the gas to the target temperature range.

Figure 4:
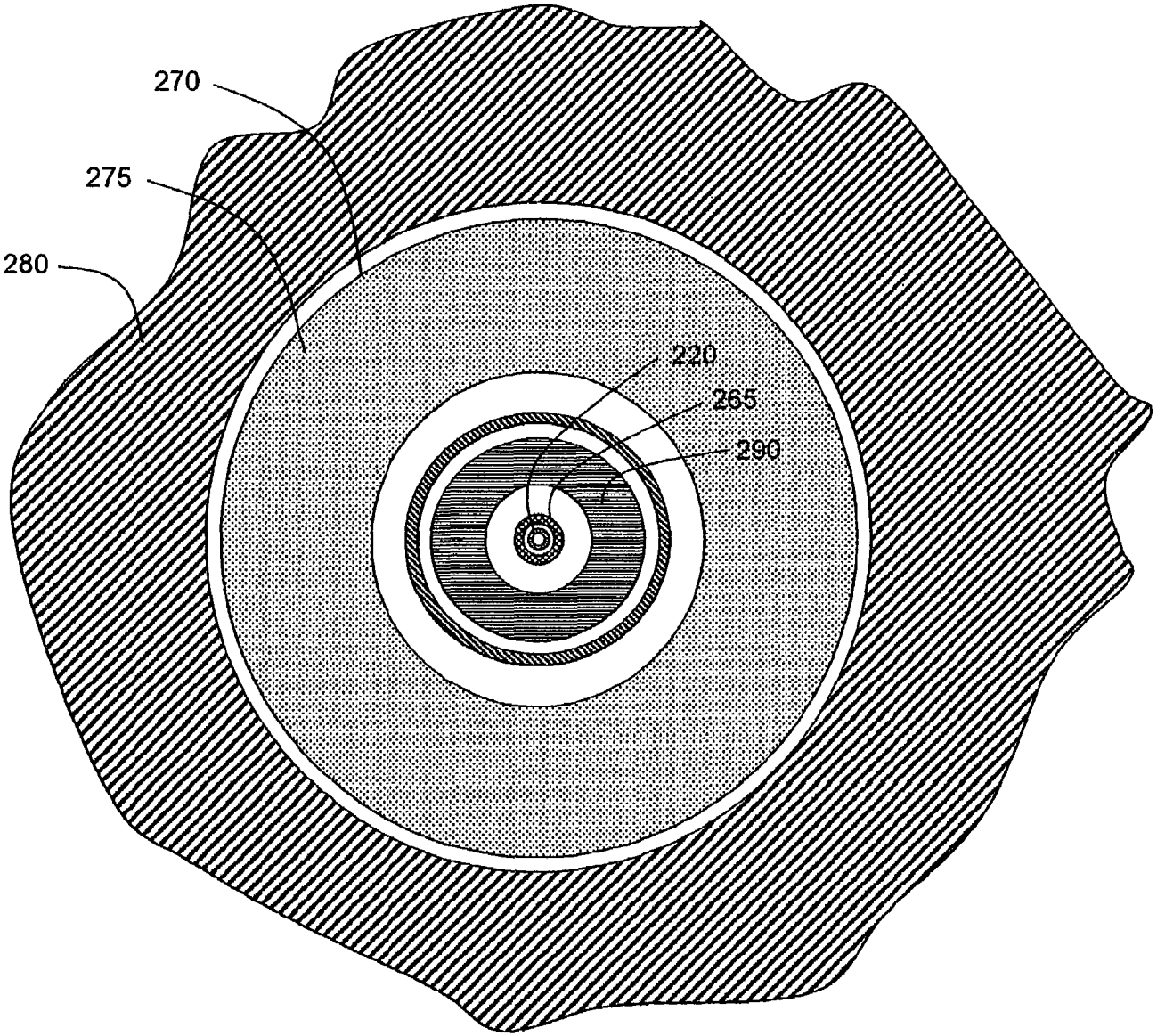
FIG. 4 is a fragmentary lateral cross-sectional view, taken through the ion probe assembly body, of the ion probe assembly depicted in FIG. 2.

While heating of the second gas stream is desirable to promote droplet desolvation, it is generally undesirable to significantly raise the temperature of the liquid sample flowing through capillary tube 220, since doing so may cause thermal decomposition of the analyte(s). To minimize heat transfer from heat exchanger assembly 270 to the liquid sample, several insulative features are placed between heater 275 and capillary tube 220. As depicted in FIG. 4, which shows a lateral cross-sectional view taken through ion probe assembly body 210, the insulative features include a ceramic insulator tube 290 radially interposed between heater 275 and capillary tube 220. Conductive heat transfer between heater 275 and the liquid within capillary tube 220 is further inhibited by the gaps between heater 275 and ceramic insulator tube 290, and between ceramic insulator tube 290 and sheath 265, and between sheath 265 and capillary tube 220. Other features may be substituted or added to effect the objective of minimizing heat transfer to the liquid.

Those skilled in the art will recognize that other techniques for heating the second gas stream may be substituted for the technique described above. For example, the second gas stream may be passed through an external heat exchanger prior to admitting the gas stream into the second gas passageway.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. Apparatus for forming ions in a mass analyzing system from a liquid sample including an analyte and a solvent, comprising:

an ionization chamber;

a capillary tube having a free end for directing the liquid sample as a spray of droplets into the ionization chamber, at least a portion of the capillary tube being maintained at a potential relative to another surface in the ionization chamber such that the droplets are electrically charged;

a first gas passageway for directing a first gas stream into the ionization chamber through an annular first end region circumferentially proximate to the free end of capillary tube, the first gas stream having a first major axis;

a second gas passageway for directing a second gas stream into the ionization chamber through a second end region disposed more remotely from the free end of the capillary tube relative to the first end region, the second gas stream being co-directional with the first gas stream and having a second major axis substantially parallel to the first major axis, the second gas stream being heated to assist in the evaporation of the solvent from the droplets to form ions of the analyte, the second gas stream being insulated from the first gas stream by at least one insulative barrier between the first and second gas streams; and an ion sampling pathway opening to the ionization chamber for guiding the ions toward a mass analyzer.

2. The apparatus of claim 1, wherein the ion sampling pathway includes a controllably-heated sampling capillary.

3. The apparatus of claim 1, further comprising a heat exchange assembly for heating the second gas stream disposed around the capillary tube.

4. The apparatus of claim 3, further comprising an insulating sleeve interposed between the heat exchange assembly and the capillary tube to minimize heat transfer to the sample liquid.

5. The apparatus of claim 3, wherein the heat exchange assembly includes a spiral pathway through which the second gas stream passes.

6. The apparatus of claim 1, wherein the second gas stream has a velocity substantially less than a velocity of the first gas stream.

7. The apparatus of claim 1, wherein the first gas stream has a velocity at the free end of the capillary tube that is substantially less than a characteristic nebulizing velocity.

8. The apparatus of claim 1, wherein the capillary tube and first and second gas passageways are housed within an ion probe assembly that penetrates a wall of the ionization chamber.

9. The apparatus of claim 8, wherein the second end region is arc-shaped.

10. The apparatus of claim 1, wherein the first major axis is transverse to a major axis of the sampling capillary.

11. Apparatus for forming ions in a mass analyzing system from a liquid sample including an analyte and a solvent, comprising:

an ionization chamber; and an ion probe assembly extending into the ionization chamber, the ion probe assembly including:

a capillary tube having a free end for introducing the liquid sample as a spray of droplets into the ionization chamber, at least a portion of the capillary tube being maintained at a potential relative to another surface in the ionization chamber to produce an electric field that charges the droplets;

a first gas passageway for directing a first gas stream into the ionization chamber through a first end region, the first end region being proximate to the free end of the capillary tube; and a second gas passageway for directing a second gas stream into the ionization chamber through a second end region disposed radially outwardly and more remotely from the free end of the capillary tube relative to the first end region, the second gas stream being heated to assist in the evaporation of the solvent from the droplets to form ions of the analyte.

12. The apparatus of claim 11, wherein the first gas stream and second gas stream are co-directional and have substantially parallel major axes.

13. The apparatus of claim 11, further comprising a heat exchange assembly for heating the second gas stream having a generally annular shape and being disposed around the capillary tube.

14. The apparatus of claim 13, further comprising an insulating sleeve interposed between the heat exchange assembly and the capillary tube to minimize heat transfer to the sample liquid.

15. The apparatus of claim 13, wherein the heat exchange assembly includes a spiral pathway through which the second gas stream passes.

16. The apparatus of claim 11, wherein the second gas stream has a velocity substantially less than a velocity of the first gas stream.

17. The apparatus of claim 11, wherein the first gas stream has a velocity at the free end of the capillary that is substantially less than a characteristic nebulizing velocity.

18. The apparatus of claim 11, further comprising a controllably heated sampling capillary having an end opening to the ionization chamber, for guiding ions toward a mass analyzer.

19. The apparatus of claim 11, wherein the ion probe assembly includes a nozzle releasably engaged with a body.

20. A method of forming ions in a mass spectrometer from a liquid sample including an analyte and a solvent, comprising steps of:

introducing the liquid sample as a spray of electrically charged droplets into an ionization chamber;

directing a first gas stream into the ionization chamber; and directing a second gas stream into the ionization chamber, said second gas stream being heated and having a velocity substantially less than a velocity of the first gas stream, the first and second gas streams being co-directional and having substantially parallel major axes.

21. The apparatus of claim 8, wherein the ion probe assembly includes a nozzle releasably engaged with a body.

22. The apparatus of claim 1, wherein a velocity of the second gas stream is approximately one half or less than a velocity of the first gas stream.

23. The method of claim 20, wherein the velocity of the second gas stream is approximately one half or less than the velocity of the first gas stream.

* * * * *